US005863191A

United States Patent [19]

Motegi et al.

[11] Patent Number: 5,863,191

[45] Date of Patent: Jan. 26, 1999

[54] SCROLL COMPRESSOR HAVING A DISCHARGE MUFFLER CHAMBER

[75] Inventors: Shuji Motegi; Toshiyuki Nakamura; Fumiaki Sano; Masayuki Kakuda; Kiyoharu Ikeda; Yoshihide Ogawa; Eiji Watanabe, all of Kanagawa; Shinji Nakashima, Hyogo, all of Japan

[73] Assignee: Mitsubishi Denki Kabushiki Kaisha, Tokyo, Japan

[21] Appl. No.: 784,524

[22] Filed: Jan. 17, 1997

Related U.S. Application Data

[62] Division of Ser. No. 536,161, Sep. 29, 1995, Pat. No. 5,674,061.

[30] Foreign Application Priority Data

Mar. 22, 1995 [JP] Japan ..... 7-62660
Jun. 26, 1995 [JP] Japan ..... 7-159494

[51] Int. Cl.[6] ..... F04C 18/04; F04C 29/06

[52] U.S. Cl. ..... 418/55.1; 418/55.4; 418/181

[58] Field of Search ..... 418/55.1, 55.4, 418/55.5, 57, 181

[56] References Cited

U.S. PATENT DOCUMENTS

| | | | |
|---|---|---|---|
| 4,427,351 | 1/1984 | Sano | 418/63 |
| 5,090,880 | 2/1992 | Mashimo | 418/55.1 |
| 5,346,375 | 9/1994 | Akiyama et al. | 418/55.1 |

FOREIGN PATENT DOCUMENTS

| | | | |
|---|---|---|---|
| 0 122 068 | 10/1984 | European Pat. Off. . | |
| 0 122 722 | 10/1984 | European Pat. Off. . | |
| 59-3198 | 1/1984 | Japan . | |
| 62-265487 | 11/1987 | Japan . | |
| 4-95684 | 8/1992 | Japan . | |
| 5-79477 | 3/1993 | Japan | 418/55.1 |
| 1 593 446 | 7/1981 | United Kingdom . | |

OTHER PUBLICATIONS

Patent Abstracts of Japan, vol. 11, No. 272, p. 122, Sep. 4, 1987, JP–A–62 075 089, Apr. 6, 1987.

*Primary Examiner*—John J. Vrablik
*Attorney, Agent, or Firm*—Oblon, Spivak, McClelland, Maier & Neustadt, P.C.

[57] ABSTRACT

The invention concerns a scroll compressor which is low in noise caused by water hammering of a refrigerant gas just after a discharge valve is closed. The scroll compressor includes a discharge member (45) having a discharge port (8) opposed to a discharge port (5) of a fixed scroll (2) and a discharge valve (9) opposed to the discharge port (8) of the discharge member (45) and opened/closed depending on a difference between flow passage pressure of a refrigerant gas and pressure in a high pressure space (27) in a sealed vessel (1). At least either of the fixed scroll (2) and the discharge member (45) is formed with a muffler chamber communicated with the discharge port (5, 8) and having a diameter larger than a diameter of the discharge port (5) of the fixed scroll (2) for suppressing occurrence of an impulse wave caused by water hammering when the discharge valve (9) is closed. Noise caused by a pressure ripple of the discharge port lessens, quieting the operation of the scroll compressor.

3 Claims, 8 Drawing Sheets

SCROLL COMPRESSOR HAVING A DISCHARGE MUFFLER CHAMBER

This is a division of application Ser. No. 08/536,161 filed on Sep. 29, 1995, U.S. Pat. No. 5,674,061.

BACKGROUND OF THE INVENTION

This invention relates to a scroll compressor provided with an orbiting scroll and a fixed scroll for use as a compressor of a refrigerator, an air conditioner, etc.

FIG. 16 is a longitudinal sectional view of a conventional scroll compressor, for example, disclosed in Japanese Patent Laid-Open No.Sho 62-265487, wherein numeral 1 is a sealed vessel and numeral 2 is a fixed scroll provided with a base plate 4 fixed to an upper frame 3 having an outer peripheral surface secured to one end face in the sealed vessel 1, a discharge port 5 disposed at the center of the base plate 4, and a plate-like spiral tooth 6 disposed on the side of the upper frame 3 of the base plate 4.

Numeral 7 is a partition plate secured in the sealed vessel 1, placed on the side of the base plate 2 of the fixed scroll 2 opposed to the upper frame 3, and provided with a discharge port 8 at the center. Numeral 9 is a discharge valve having a valve guard mounted on the side of the partition plate 7 opposed to the fixed scroll 2 with a bolt 11. Numeral 12 is an orbiting scroll disposed between the fixed scroll 2 and the upper frame 3 and having a base plate 13 provided with a plate-like spiral tooth 15 engaging the plate-like spiral tooth 6 of the fixed scroll 2 for forming a compression space 14.

Numeral 16 is an orbiting shaft disposed on the side of the base plate 13 of the orbiting scroll 12 opposed to the fixed scroll 2. Numeral 17 is a thrust face which is formed on the side of the orbiting shaft 16 of the base plate 13 of the orbiting scroll 12 and comes in plane contact with a thrust bearing 18 of the upper frame 3 for sliding. Numeral 19 is an Oldham's ring having an upper claw engaged slidably in a linear direction in a pair of Oldham's guide grooves formed on the outer peripheral surface of the base plate 13 of the orbiting scroll 12.

The upper frame 3 is also formed with Oldham's guide grooves having a phase difference of about 90° with the Oldham's guide grooves of the orbiting scroll 12, in which a lower claw of the oldham's ring 19 is engaged slidably in a linear direction.

Numeral 20 is a lower frame which has an outer peripheral surface secured in the sealed vessel 1, is placed on the side of the upper frame 3 opposed to the orbiting scroll 12, and is provided with a main bearing radially supporting a main shaft 22 driven by an electric motor 21 at the center.

Numeral 24 is an orbiting bearing which is disposed at an end of the orbiting scroll 12 side of the main shaft 22 and is formed like a circular cylinder eccentric in the same direction as the eccentric direction of the orbiting scroll 12 for pivotally supporting the orbiting shaft 16 of the base plate 13 of the orbiting scroll 12.

Numeral 25 is a suction pipe for guiding a low-pressure refrigerant gas before compressed to the inside of the sealed vessel 1 and numeral 26 is a discharge pipe for discharging a high-pressure refrigerant gas after compressed to the outside of the sealed vessel 1.

Numeral 27 is a high pressure space formed between the end face of the sealed vessel 1 and the partition plate 7. Numerals 28 to 30 are a compression space 14 formed like a pair of crescents with the plate-like spiral tooth 6 of the fixed scroll 2 meshing with the plate-like spiral tooth 15 of the orbiting scroll 12; numeral 28 is a high pressure chamber, numeral 29 is an intermediate pressure chamber, and a numeral 30 is a low pressure chamber. Numeral 31 is a compression high pressure section formed by the high pressure chamber 28, the discharge port 5 of the fixed scroll 2, and the discharge port 8 of the partition plate 7.

The conventional scroll compressor has the above structure. When the electric motor 21 is energized, the orbiting scroll 12 is driven via the main shaft 22 and the orbiting shaft 16. At this time, rotation of the orbiting scroll 12 with respect to the upper frame 3, namely, the fixed scroll 2 is restrained by the Oldham's ring 19. Thus, the orbiting scroll 12 makes the orbiting motion with respect to the fixed scroll 2.

A refrigerant gas sucked through the suction pipe 25 is taken in the low pressure chamber 30 of the compression space 14 formed like a pair of crescents with the plate-like spiral tooth 6 of the fixed scroll 2 meshing with the plate-like spiral tooth 15 of the orbiting scroll 12.

The compression space 14 decreases in volume in order from the low pressure chamber 30 to the intermediate pressure chamber 29 to the high pressure chamber 28, whereby the refrigerant gas is compressed.

Next, the compressed high-pressure refrigerant gas passes through the discharge port 5 of the fixed scroll 2 and the discharge port 8 of the partition plate 7, pushes and opens the discharge valve 9, is discharged into the high pressure space 27, and is sent outside the sealed vessel 1. Just after the scroll compressor stops, the discharge valve 9 is closed, preventing the refrigerant gas in the high pressure space 27 from passing through the compression high pressure section 31 and flowing reversely to the refrigerant gas flow at the normal motion time, thereby blocking the reverse orbiting operation of the orbiting scroll 12 to the normal motion time.

The discharge valve 9 opens for discharging high-pressure refrigerant gas almost throughout the time from starting to stopping of the scroll compressor operation. The operating scroll compressor has a characteristic wherein the high pressure chamber 28 and the intermediate pressure chamber 29 formed by the plate-like spiral tooth 6 of the fixed scroll 2 and the plate-like spiral tooth 15 of the orbiting scroll 12 are communicated with each other at a predetermined timing.

Just after the high pressure chamber 28 and the intermediate pressure chamber 29 are communicated with each other, the pressure in the compression high pressure section 31 becomes lower than the pressure in the high pressure space 27, closing the discharge valve 9. An impulse wave is produced in the compression high pressure section 31 by water hammering of the refrigerant gas in the vicinity of the discharge valve 9 when the discharge valve 9 is closed. A pressure ripple in the discharge port 5 of the fixed scroll 2 caused by the impulse wave becomes a vibration source, increasing noise of the scroll compressor.

FIGS. 17, 18A, and 18B show another conventional scroll compressor, for example, disclosed in Japanese Patent Laid-Open No.Sho 62-75089. FIG. 17 is a longitudinal sectional view of the main part of the conventional scroll compressor and each of FIGS. 18A and 18B is a plan view explaining the operation of the scroll compressor in FIG. 17. Parts not shown in FIG. 17, 18A or 18B are the same as those of the scroll compressor in FIG. 16. Parts identical with or similar to those previously described with reference to FIG. 16 are denoted by the same reference numerals in FIGS. 17, 18A and 18B. Numeral 32 is an orbiting bearing disposed on the side of a base plate 13 of an orbiting scroll 12 opposed to a fixed scroll 2, in which an orbiting shaft 16 of the base plate 13 of the orbiting scroll 12 is fitted rotatably.

Numeral 33 is a thrust member which is disposed on a surface facing the base plate 13 of the orbiting scroll 12 of an upper frame 3 and comes in plane contact with the base plate 13 for sliding. Numeral 34 is an Oldham's guide groove formed in the upper frame 3 and placed forming a phase difference of about 90° with an Oldham's guide groove of the orbiting scroll 12, in which a lower claw 35 of an Oldham's ring 19 is engaged slidably in a linear direction.

Numeral 36 is a counterboring part disposed in a base plate 4 of the fixed scroll 2 and having a cutaway part corresponding to the center of a plate-like spiral tooth 6. Numeral 37 is a counterboring part disposed in the base plate 13 of the orbiting scroll 12 and having a cutaway part corresponding to the center of a plate-like spiral tooth 15.

The conventional scroll compressor has the structure. When an electric motor 21 is energized, the orbiting scroll 12 is driven via a main shaft 22 and the orbiting shaft 16. At this time, rotation of the orbiting scroll 12 with respect to the upper frame 3, namely, the fixed scroll 2 is restrained by the Oldham's ring 19. Thus, the orbiting scroll 12 make the orbiting motion with respect to the fixed scroll 2.

A refrigerant gas sucked through a suction pipe 25 in taken in a low pressure chamber 30 of a compression space 14 formed like a pair of crescents with the plate-like spiral tooth 6 of the fixed scroll 2 meshing with the plate-like spiral tooth 15 of the orbiting scroll 12.

The compression space 14 decreases in volume in order from the low pressure chamber 30 to an intermediate pressure chamber 29 to a high pressure chamber 28, whereby the refrigerant gas is compressed.

Next, the compressed high-pressure refrigerant gas is discharged through the counterboring part 36 of the fixed scroll 2, the counterboring part 37 of the orbiting scroll 12, and a discharge port 5 of the fixed scroll 2. As shown in FIG. 18, the counterboring part 36 of the fixed scroll 2 and the counterboring part 37 of the orbiting scroll 12 defining a flow passage of high-pressure refrigerant gas at a predetermined timing are communicated with the intermediate pressure chamber 29.

Therefore, the counterboring part 36 of the fixed scroll 2 and the counterboring part 37 of the orbiting scroll 12 provide a discharge flow passage when the refrigerant gas is discharged, decreasing a discharge pressure loss, thereby decreasing scroll compressor input caused by the discharge pressure loss. However, when the counterboring parts 36 and 37 are communicated with the intermediate pressure chamber 29, the high-pressure refrigerant gas is returned to the intermediate pressure chamber 29, then again discharged through the discharge port 5 of the fixed scroll 2 by the compression operation of the compression space 14.

In the conventional scroll compressor as described above, if the discharge valve 9 is omitted, the orbiting scroll 12 performs the reverse orbiting operation to the normal motion time just after the scroll compressor stops. Since it is feared at the time that reverse rotation noise may be produced or that the orbiting bearing 32, etc., may be damaged depending on the situation, the discharged valve 9 is provided.

However, if the discharged valve 9 is closed during the operation of the scroll compressor, an impulse wave is produced in the discharge port 5 of the fixed scroll 2 by water hammering of the refrigerant gas in the vicinity of the discharge valve 9. Noise occurs with the impulse wave as a vibration source, causing noise of the scroll compressor to increase.

The counterboring part 36 of the fixed scroll 2 and the counterboring part 37 of the orbiting scroll 12 defining a flow passage of high-pressure refrigerant gas at a predetermined timing during the operation of the scroll compressor are communicated with the intermediate pressure chamber 29. Since the pressure in the intermediate pressure chamber 29 of the compression space 14 instantly increases just after they are communicated, the fixed scroll 2 and the orbiting scroll 9 are vibrated, increasing noise of the scroll compressor.

SUMMARY OF THE INVENTION

It is therefore a first object of the invention to provide a scroll compressor which is provided with a discharge valve and is low in noise caused by water hammering of a refrigerant gas just after the discharge valve is closed.

It is a second object of the invention to provide a scroll compressor which has fixed and orbiting scrolls provided with counterboring parts and is low in noise caused by pressure fluctuation in an intermediate pressure chamber when the counterboring parts are communicated with the intermediate pressure chamber.

According to the invention, there is provided a scroll compressor comprising a fixed scroll disposed in a sealed vessel and provided with a plate-like spiral tooth on a base plate having a discharge port for a high-pressure refrigerant gas at a center, an orbiting scroll disposed in the sealed vessel and having a base plate provided with a plate-like spiral tooth engaging the plate-like spiral tooth of the fixed scroll for forming a compression space, a discharge valve disposed at a high pressure space entrance of a refrigerant gas flow passage from the discharge port of the fixed scroll to high pressure space of the sealed vessel and opened/closed depending on a difference between pressure in a flow passage of the refrigerant gas and pressure in the high pressure space for allowing the refrigerant gas flow passage and the high pressure space to communicate with each other and shutting off them, and a muffler chamber communicating with the refrigerant gas flow passage from the discharge port of the fixed scroll to the discharge valve for absorbing pressure ripple when the discharge valve is closed.

The muffler chamber is an enlarged part of a flow passage cross section formed in the refrigerant gas flow passage from the discharge port of the fixed scroll to the discharge valve.

The scroll compressor comprises a discharge member disposed in the sealed vessel and placed facing the base plate of the fixed scroll and having a discharge port opposed to the discharge port of the fixed scroll, a discharge valve opposed to the discharge port of the discharge member and opened/closed depending on a difference between pressure in refrigerant gas flow passage and pressure in high pressure space, and a muffler chamber formed in at least either of the base plate of the fixed scroll and the discharge member and having a diameter larger than that of the discharge port of the fixed scroll.

The scroll compressor comprises a muffler chamber having a height dimension along a longitudinal axis line of the sealed vessel smaller than the diameter dimension of the discharge port of the fixed scroll.

The scroll compressor comprises a muffler chamber having a center placed concentrically with the discharge port of the fixed scroll.

The scroll compressor comprises a muffler chamber having a center placed concentrically with a longitudinal axis line of the sealed vessel.

The muffler chamber is a hollow part communicating through a pressure guide path with the refrigerant gas flow passage from the discharge port of the fixed scroll to the discharge valve.

The scroll compressor having the hollow part comprises a discharge member disposed in the sealed vessel and placed facing the base plate of the fixed scroll and having a discharge port opposed to the discharge port of the fixed scroll, a discharge valve opposed to the discharge port of the discharge member and opened/closed depending on a difference between pressure in refrigerant gas flow passage and pressure in high pressure space, and a muffler chamber formed in at least either of the base plate of the fixed scroll and the discharge member.

The scroll compressor comprises a muffler chamber having a volume to a degree of preventing the orbiting scroll from making the orbiting motion in a reverse direction to normal motion time when a reverse flow of refrigerant gas occurs just after the scroll compressor stops.

The scroll compressor comprises a discharge member disposed on a sealed vessel discharge pipe side of the fixed scroll base plate and a muffler chamber formed between the discharge member and the fixed scroll base plate.

The scroll compressor comprises a fixed scroll disposed axially movably on an axis line of the sealed vessel and mounted by an axial compliant structure, a high and low pressure separator disposed in the sealed vessel and placed facing the base plate of the fixed scroll and having a discharge port opposed to the discharge port of the fixed scroll, and a muffler chamber formed between the fixed scroll base plate and the high and low pressure separator.

According to the invention, there is provided a scroll compressor comprising a fixed scroll disposed in a sealed vessel and provided with a plate-like spiral tooth on a base plate having a discharge port for a high-pressure refrigerant gas at a center, an orbiting scroll disposed in the sealed vessel and having a base plate provided with a plate-like spiral tooth engaging the plate-like spiral tooth of the fixed scroll for forming a compression space consisting of a high pressure chamber, an intermediate pressure chamber, and a low pressure chamber, and a counterboring part made in at least either of the base plates of the fixed and orbiting scrolls, having a cutaway part corresponding to a center of the plate-like spiral tooth of the base plate, and set to a form and position such that when the fixed and orbiting scrolls operate, the counterboring part communicates with the intermediate pressure chamber at a later timing than the high pressure chamber and the intermediate pressure chamber communicate with each other on side faces of the plate-like spiral teeth of the fixed and orbiting scrolls.

The scroll compressor comprises a counterboring part made in at least either of the base plates of the fixed and orbiting scrolls, having a cutaway part corresponding to a center of the plate-like spiral tooth of the base plate, and set to a form and position such that when the fixed and orbiting scrolls operate, the counterboring part communicates with the intermediate pressure chamber at the same timing as the discharge port of the fixed scroll communicates with the intermediate pressure chamber.

According to the invention, there is provided a scroll compressor comprising a fixed scroll disposed in a sealed vessel and provided with a plate-like spiral tooth on a base plate having a discharge port for a high-pressure refrigerant gas at a center, an orbiting scroll disposed in the sealed vessel and having a base plate provided with a plate-like spiral tooth engaging the plate-like spiral tooth of the fixed scroll for forming a compression space consisting of a high pressure chamber, an intermediate pressure chamber, and a low pressure chamber, and a counterboring part made in at least either of the base plates of the fixed and orbiting scrolls and having a cutaway part corresponding to a center of the plate-like spiral tooth of the base plate and a part formed along an involute curve.

At least either of the fixed and orbiting scrolls is provided with a plate-like spiral tooth having a notch at a tip center of a center.

In the scroll compressor having the structure, the muffler chamber suppresses occurrence of an impulse wave caused by pressure ripple in the discharge port of the fixed scroll just after the discharge valve is closed.

Since the muffler chamber is an enlarged part of a flow passage cross section formed in the refrigerant gas flow passage from the discharge port of the fixed scroll to the discharge valve, the enlarged part of the flow passage cross section suppresses occurrence of an impulse wave caused by pressure ripple in the discharge port.

Installation of the discharge member provided with the discharge valve makes muffler chamber installation more flexible.

Since the muffler chamber has a height dimension along a longitudinal axis line of the sealed vessel smaller than the diameter dimension of the discharge port of the fixed scroll, a pressure loss caused by refrigerant gas eddy occurrence, etc., in the muffler chamber decreases.

Since the muffler chamber has the center placed concentrically with the discharge port of the fixed scroll, pressure ripple of high-pressure refrigerant gas in the muffler chamber spreads uniformly in the axial direction of the sealed vessel.

Since the muffler chamber has the center placed concentrically with a longitudinal axis line of the sealed vessel, it becomes concentric with related members such as the high and low pressure separator having the muffler chamber and is easily machined.

Since the muffler chamber is a hollow part communicating through a pressure guide path with the refrigerant gas flow passage from the discharge port of the fixed scroll to the discharge valve, it becomes of resonance type and pressure ripple of high-pressure refrigerant gas caused by specific frequencies in the discharge port of the fixed scroll can be damped efficiently.

Since the hollow part defines the resonance-type muffler chamber and the discharge member is provided with the discharge valve, muffler chamber installation is made more flexible.

Since the muffler chamber has a volume to a degree of preventing the orbiting scroll from making the orbiting motion in a reverse direction to normal motion time when a reverse flow of refrigerant gas occurs just after the scroll compressor stops, reverse rotation sound just after the scroll compressor stops is not produced.

Since the muffler chamber is disposed between the discharge member on the sealed vessel discharge pipe side of the fixed scroll base plate and the fixed scroll base plate, it can be easily formed.

Since the high and low pressure separator is placed facing the base plate of the fixed scroll disposed axially movably on an axis line of the sealed vessel and mounted by an axial compliant structure and the muffler chamber is formed between the fixed scroll base plate and the high and low pressure separator, the muffler chamber can be easily mounted without losing the axial compliant function.

The counterboring part is made in at least either of the base plates of the fixed and orbiting scrolls, has a cutaway part corresponding to the center of the plate-like spiral tooth of the base plate, and is set to a form and position such that it communicates with the intermediate pressure chamber at a later timing than the high pressure chamber and the intermediate pressure chamber communicate with each other on side faces of the plate-like spiral teeth of the fixed and orbiting scrolls. Thus, the scroll compressor has the structure wherein the counterboring part is made in at least either of the base plates of the fixed and orbiting scrolls, decreasing rapid and large pressure change in the compression space when the counterboring part communicates with the intermediate pressure chamber.

The counterboring part is made in at least either of the base plates of the fixed and orbiting scrolls, has a cutaway part corresponding to the center of the plate-like spiral tooth of the base plate, and is set to a form and position such that it communicates with the intermediate pressure chamber at the same timing as the discharge port of the fixed scroll communicates with the intermediate pressure chamber. Thus, pressure change in the intermediate pressure chamber when the counterboring part communicates with the intermediate pressure chamber occurs once per revolution.

The counterboring part is made in at least either of the base plates of the fixed and orbiting scrolls and has a cutaway part corresponding to the center of the plate-like spiral tooth of the base plate and a part formed along an involute curve, whereby just after either of the counterboring parts of the fixed and orbiting scrolls communicates with the intermediate pressure chamber, a communication area is formed in a wide range along the outer side faces of the opposed plate-like spiral teeth. Thus, a sufficient flow passage area of a high-pressure refrigerant gas is provided, decreasing a pressure loss of the high-pressure refrigerant gas.

At least either of the fixed and orbiting scrolls formed with the counterboring part is provided with a plate-like spiral tooth having a notch at the a tip center of the center, whereby the high-pressure refrigerant gas flow passage is enlarged to the area resulting from adding the notch to the counterboring part, furthermore decreasing the pressure loss of the high-pressure refrigerant gas.

Figure 13:
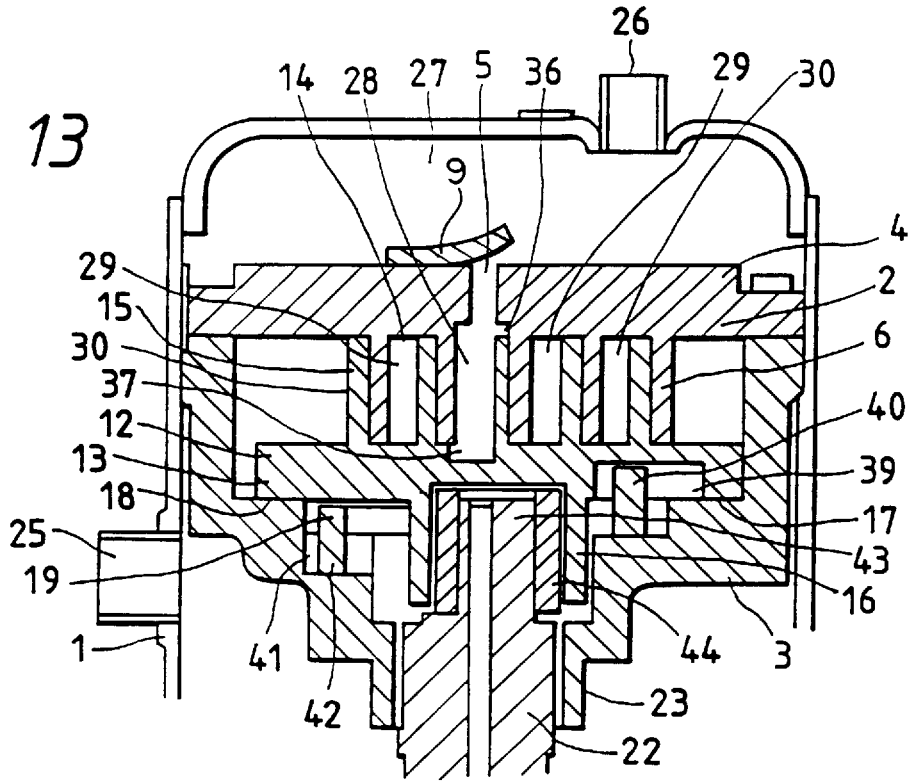
FIG. 13 is a longitudinal sectional view showing the main part of a sixth embodiment of the invention.
Figure 14A:
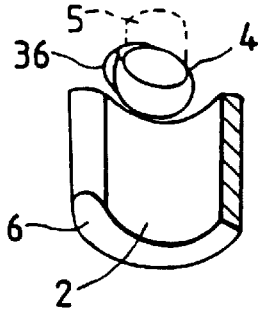
Figure 14B:
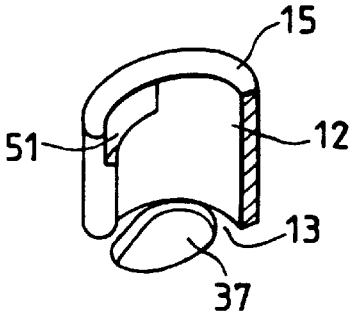
Figure 15A:
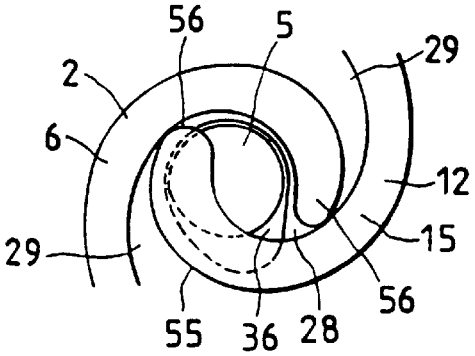
Figure 15C:
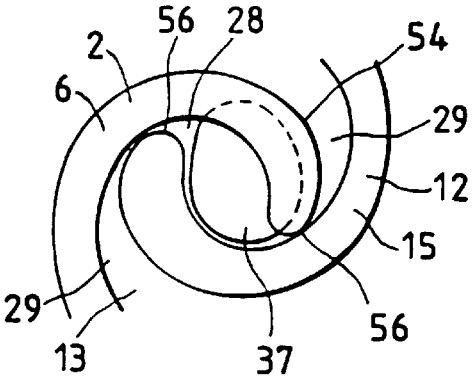
Figure 15B:
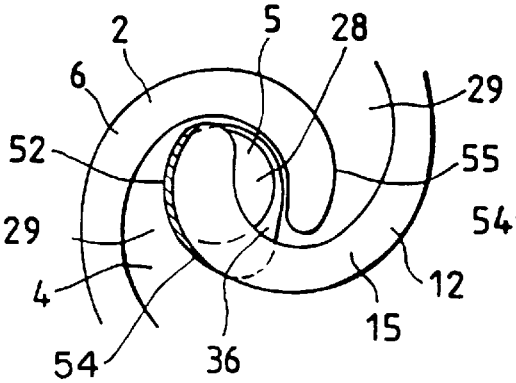
Figure 15D:
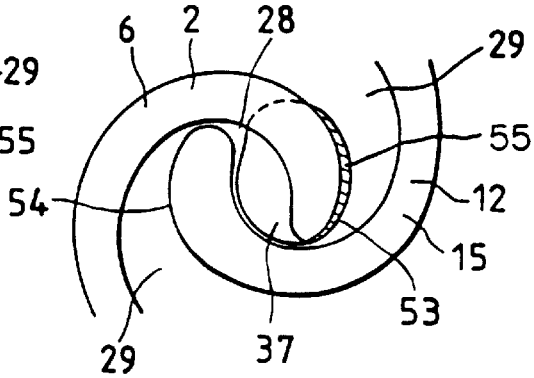
Figure 16:
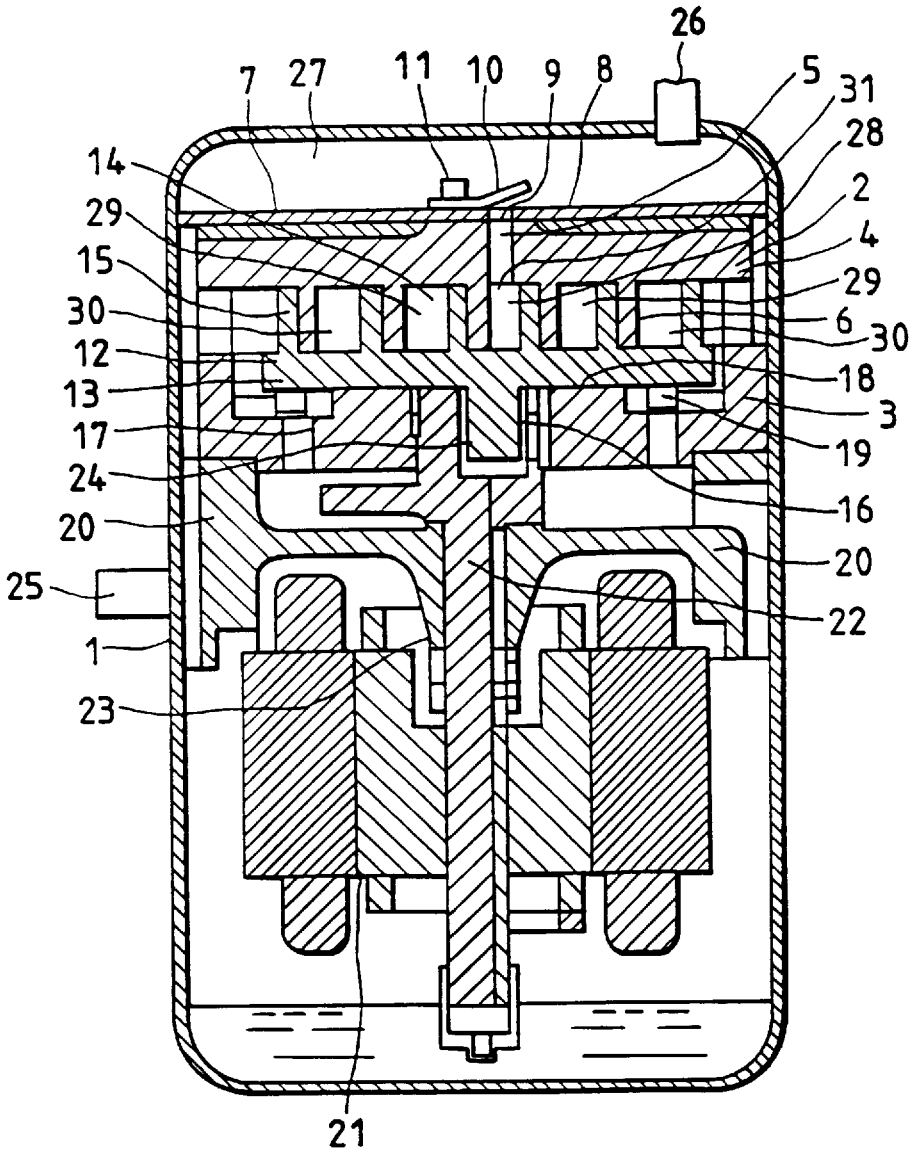
FIG. 16 PRIOR ART
Figure 17:
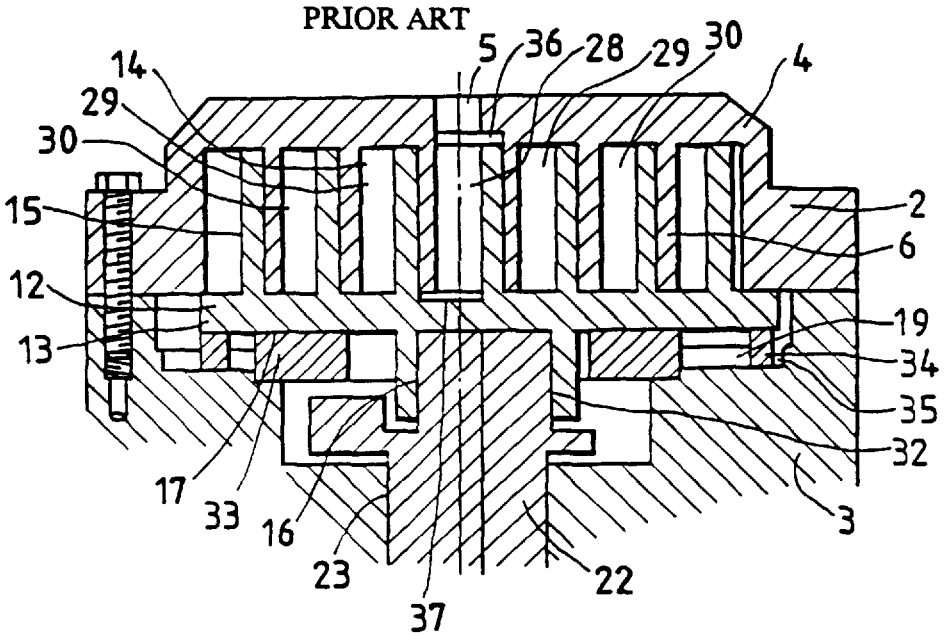
FIG. 17 PRIOR ART
Figure 18A:
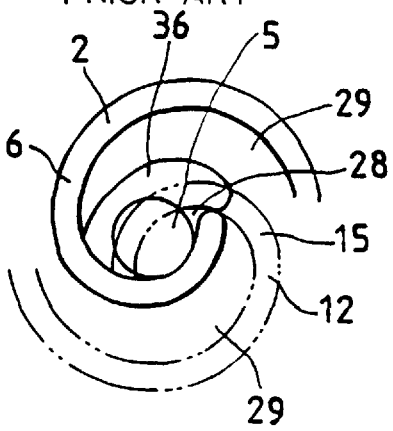
FIG. 18A PRIOR ART
Figure 18B:
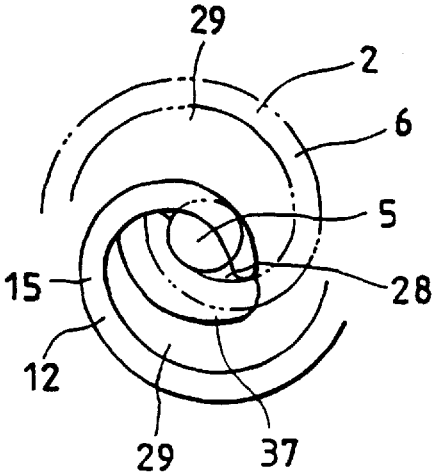
FIG. 18B PRIOR ART

Each of FIG. 14A and 14B is an enlarged perspective view of a respective counterboring part in FIG. 13;

Each of FIGS. 15A to 15D is a plan view explaining the operation of scroll compressor in FIG. 13;

FIG. 16 is a longitudinal sectional view of a conventional scroll compressor;

FIG. 17 is a longitudinal sectional view of the main part of another conventional scroll compressor; and Each of FIGS. 18A and 18B is a plan view explaining the operation of scroll compressor in FIG. 17.

DETAILED DESCRIPTION OF THE PREFERRED EMBODIMENTS

Figure 1:
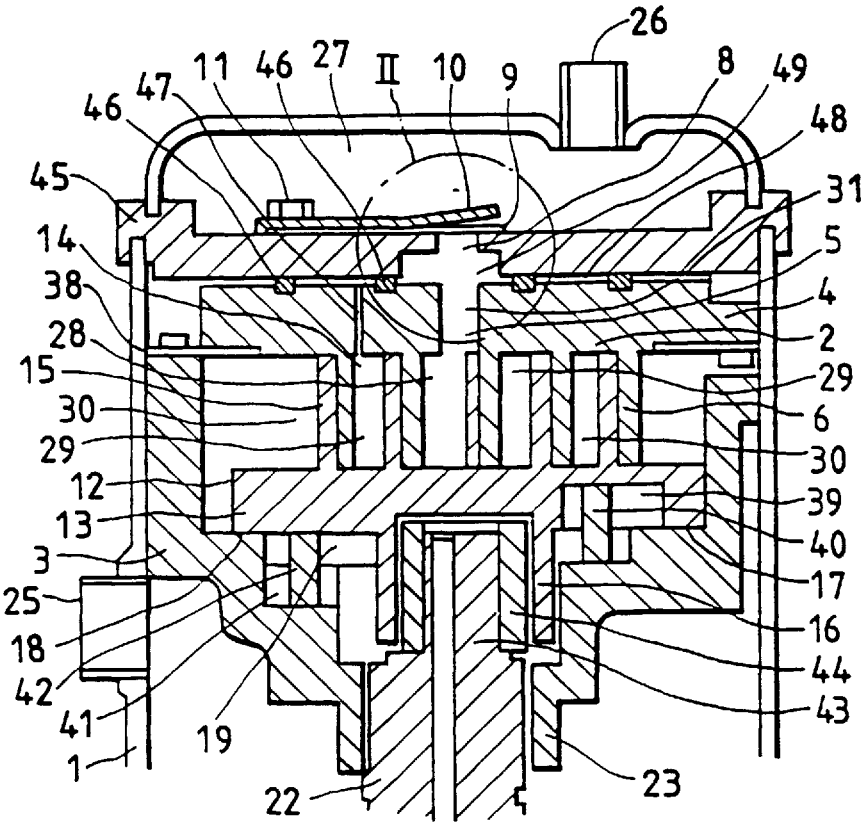
FIG. 1 is a longitudinal sectional view showing the main part of a first embodiment of the invention.
Figure 2:
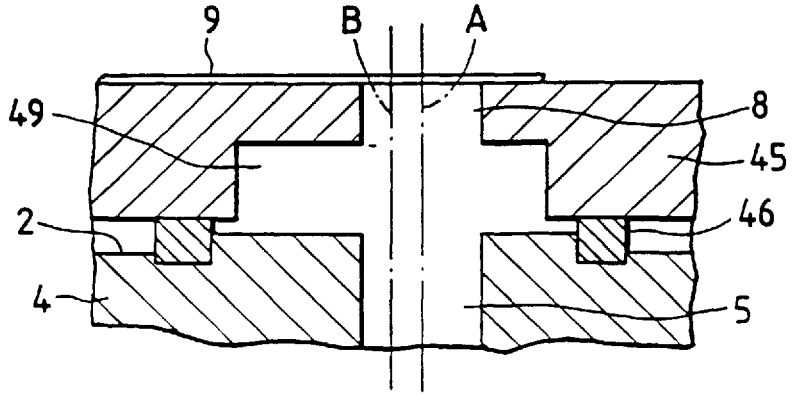
FIG. 2 is an enlarged longitudinal sectional view of part II in FIG. 1.

First embodiment:

FIGS. 1 and 2 show a first embodiment of the invention. FIG. 1 is a longitudinal sectional view of the main part and FIG. 2 is an enlarged view of part II in FIG. 1. In the figures, numeral 1 is a sealed vessel and numeral 2 is a fixed scroll provided with a base plate 4 placed to one end face in the sealed vessel 1 and having an outer peripheral surface fixed to a frame 3 via a plate spring 38, a discharge port 5 disposed at the center of the base plate 4, and a plate-like spiral tooth 6 disposed on the side of the frame 3 of the base plate 4. The frame 3 has an outer peripheral surface secured in the sealed vessel 1 by a shrinkage fit.

The plate spring 38 presses axially the fixed scroll 2 against an orbiting scroll (described just below) by a predetermined press force.

Numeral 12 is the orbiting scroll disposed between the fixed scroll 2 and the frame 3 and having a base plate 13 provided with a plate-like spiral tooth 15 engaging the plate-like spiral tooth 6 of the fixed scroll 2 for forming a compression space 14.

Numeral 16 is an orbiting bearing formed like a circular cylinder and disposed on the side of the base plate 13 of the orbiting scroll 12 opposed to the fixed scroll 2. Numeral 17 is a thrust face which is formed on the side of the orbiting bearing 16 of the base plate 13 of the orbiting scroll 12 and comes in plane contact with a thrust bearing 18 of the frame 3 for sliding. Numeral 19 is an Oldham's ring having an upper claw 40 engaged slidably in a linear direction in a pair of Oldham's guide grooves formed in the inside of the thrust face 17 of the orbiting scroll 12.

The frame 3 is also formed with Oldham's guide grooves 41 having a phase difference of about 90° with the Oldham's guide grooves of the orbiting scroll 12, in which a lower claw 42 of the Oldham's ring 19 is engaged slidably in a linear direction. Numeral 23 is a main bearing disposed at the center of the frame 3 for radially supporting a main shaft 22 driven by an electric motor 21.

Numeral 43 is a pin part disposed at the end of the orbiting scroll 12 side of the main shaft 22 and having a plane in the same direction as the eccentric direction of the orbiting scroll 12, in which a slider 44 rotatably placed in the orbiting bearing 16 of the orbiting scroll 12 is rotatably fitted.

Numeral 45 is a discharge member (a high and low pressure separator), which is secured in the sealed vessel 1 by welding and placed between the base plate 4 of the fixed scroll 2 and the end face of the sealed vessel 1 and has a discharge port 8 disposed at the center. Numeral 46 is a seal member disposed between the base plate 4 of the fixed scroll 2 and the discharge member 45. Numeral 47 is an extraction port disposed in the base plate 4 of the fixed scroll 2 for guiding pressure in a compression space 14 defined by the plate-like spiral tooth 6 of the fixed scroll 2 and the plate-like spiral tooth 15 of the orbiting scroll 12 to a back pressure chamber 48.

Numeral 49 is a muffler chamber which is disposed in the discharge member 45, is placed facing the base plate 4 of the fixed scroll 2, is communicated with the discharge port 8, and is placed substantially matching the axle center of the sealed vessel 1 for forming a column-like space larger diameter and shallower in depth than the diameter of discharge port 5 of the fixed scroll 2.

Numeral 9 is a discharge valve which is disposed on the side of the discharge member 45 opposed to the fixed scroll 2, is placed corresponding to the discharge port 8, and has a valve guard 10 mounted on the discharge member 45 with a volt 11.

Numeral 25 is a suction pipe for guiding a low-pressure refrigerant gas before compressed to the inside of the sealed vessel 1 and numeral 26 is a discharge pipe for discharging a high-pressure refrigerant gas after compressed to the outside of the sealed vessel 1.

Numeral 27 is a high pressure space formed between the end face of the sealed vessel 1 and the discharge member 45. Numerals 28 to 30 are a compression space 14 formed like a pair of crescents with the plate-like spiral tooth 6 of the fixed scroll 2 meshing with the plate-like spiral tooth 15 of the orbiting scroll 12; numeral 28 is a high pressure chamber, numeral 29 is an intermediate pressure chamber, and a numeral 30 is a low pressure chamber.

Numeral 31 is a compression high pressure section formed by the high pressure chamber 28, the discharge port 5 of the fixed scroll 2, and the discharge port 8 and the muffler chamber 49 disposed in the discharge member 45.

In FIG. 2, center line A is the center line of the discharge port 5 of the fixed scroll 2 and center line B is the center line of the sealed vessel 1 and the muffler chamber 49.

In the scroll compressor having the structure, when the electric motor is energized, the orbiting scroll 12 is driven via the main shaft 22, the slider 44 revolved by the main shaft 22, and the orbiting bearing 16. At this time, rotation of the orbiting scroll 12 with respect to the frame 3, namely, the fixed scroll 2 is restrained by the Oldham's ring 19. Thus, the orbiting scroll 12 makes the orbiting motion with respect to the fixed scroll 2.

A low-pressure refrigerant gas sucked through the suction pipe 25 is taken in the low pressure chamber 30 of the compression space 14 formed like a pair of crescents with the plate-like spiral tooth 6 of the fixed scroll 2 meshing with the plate-like spiral tooth 15 of the orbiting scroll 12.

The compression space 14 decreases in volume in order from the low pressure chamber 30 to the intermediate pressure chamber 29 to the high pressure chamber 28, whereby the refrigerant gas is compressed.

Next, the compressed high-pressure refrigerant gas passes through the discharge port 5 of the fixed scroll 2 and the muffler chamber 49 and the discharge port 8 of the discharge member 45, opens the discharge valve 9, is discharged into the high pressure space 27, and is sent outside the sealed vessel 1. The plane of the pin part 43 of the main shaft 22 and the plane of the inner face of the slider 44 make linear slide motion in the eccentric direction of the orbiting scroll 12.

Thus, a predetermined force such as a centrifugal force acts on the orbiting scroll 12 in the eccentric direction, whereby the orbiting scroll 12 is pressed in the radial direction of the fixed scroll 2, thereby preventing a gap from occurring between the side face of the plate-like spiral tooth 15 of the orbiting scroll 12 and the side face of the plate-like spiral tooth 6 of the fixed scroll 2.

The pressure in the intermediate pressure chamber 29 is guided into the back pressure chamber 48 through the extraction port 47. A force produced by the pressure in the back pressure chamber 48 and the pressure in the muffler chamber 49 acts on the base plate 4 of the fixed scroll 2 and a press force of the plate spring 38 acts on the outer peripheral surface of the base plate 4 of the fixed scroll 2.

Thus, the fixed scroll 2 is pressed against the orbiting scroll 12 in the axial direction due to the difference between the press force and the force produced by the pressure in the low pressure chamber 30, the intermediate pressure chamber 29, and the high pressure chamber 28, thereby preventing a gap from occurring between the tip of the plate-like spiral tooth 6 of the fixed scroll 2 and the base plate 13 of the orbiting scroll 12. That is, an axial compliant structure is formed.

When the discharge valve 9 is closed just after the scroll compressor stops, a flow from the compression high pressure section 31 to the intermediate pressure chamber 28, namely, a flow reverse to a refrigerant gas flow at the normal motion time occurs. If a volume of a muffler chamber is not smaller than a predetermined value, the orbiting scroll makes an orbiting motion reversely with respect to that in the normal motion time when such a reverse flow of refrigerant gas occurs. However, the muffler chamber 49 of the discharge member 45 is set to a volume to such a degree that the orbiting scroll 12 does not make the orbiting motion in the reverse direction to the normal motion time. Thus, reverse rotation noise just after the scroll compressor stops does not occur, so that the operation of the scroll compressor can be made quiet and bearing failure of the scroll compressor can be prevented from occurring.

The discharge valve 9 opens for discharging high-pressure refrigerant gas almost throughout the time from starting to stopping of the scroll compressor operation. The operating scroll compressor has a characteristic wherein the high pressure chamber 28 and the intermediate pressure chamber 29 formed by the plate-like spiral tooth 6 of the fixed scroll 2 and the plate-like spiral tooth 15 of the orbiting scroll 12 are communicated with each other at a predetermined timing.

Just after the high pressure chamber 28 and the intermediate pressure chamber 29 are communicated with each other, the pressure in the compression high pressure section 31 becomes lower than the pressure in the high pressure space 27, closing the discharge valve 9. A pressure ripple is produced in the compression high pressure section 31 by water hammering of the refrigerant gas in the vicinity of the discharge valve 9 when the discharge valve 9 is closed.

The smaller the pressure drop amount in the compression high pressure section 31, the smaller is the pressure ripple produced in the compression high pressure section 31 by water hammering of the refrigerant gas in the vicinity of the discharge valve 9. According to gas mixing theory, the larger the volume of the compression high pressure section 31 and the smaller the pressure difference between the compression high pressure section 31 and the intermediate pressure chamber 29 just before communication, the smaller is the pressure drop amount in the compression high pressure section 31.

For the pressure ripple, the volume of the compression high pressure section 31 is sufficiently enlarged by the muffler chamber 49 of the discharge member 45, so that the pressure ripple in the compression high pressure section 31 is damped, producing no impulse wave. Therefore, noise of the scroll compressor with the pressure ripple in the discharge ports of the fixed scroll 2 and the discharge member 45 as a vibration source can be suppressed for quieting the operation of the scroll compressor.

From the relationship between the flow in the longitudinal axis line direction of the sealed vessel 1 and the axial flow with respect to the refrigerant gas flow in the muffler chamber 49, the higher the height of the longitudinal axis line direction of the muffler chamber 49, the greater the chance of eddy occurrence in the muffler chamber 49; particularly if it is higher than the diameter of the discharge port 5 of the fixed scroll 2, eddy occurrence remarkably increases. Therefore, the height along the longitudinal line of the muffler chamber 49 is made smaller than the diameter of the discharge port 5 of the fixed scroll 2, so that a pressure loss caused by eddy occurrence of refrigerant gas, etc., in the muffler chamber 49 does not increase, whereby performance of the scroll compressor can be prevented from lowering although the muffler chamber 49 is provided for quieting the operation of the scroll compressor.

Since the muffler chamber 49 is provided almost concentrically with the longitudinal axis line of the sealed vessel 1, it becomes almost concentric with the outer peripheral surface of the discharge member 45, etc., having the muffler chamber 49. Thus, when the muffler chamber is machined, it can be easily fixed to a working machine, saving machining costs.

The discharge valve 9 is installed in the discharge member 45 in FIG. 1, but the high pressure space 27 may be partitioned by the fixed scroll 2 in the sealed vessel 1 for installing the discharge valve 9 on the high pressure space 27 side of the base plate 4 of the fixed scroll 2 without providing the discharge member 45, as shown in FIG. 13 below.

The muffler chamber 49 can be provided by forming an enlarged part of the flow passage cross section of the refrigerant flow passage between the discharge port 5 and the discharge valve 9 in the refrigerant flow passage from the discharge port 5 of the fixed scroll 2 via the discharge valve 9 to the high pressure space 27.

At this time, the upper limit volume of the muffler chamber 49 may be set within the range in which the orbiting scroll 12 does not cause reverse rotation when the discharge valve 9 is closed just after the scroll compressor stops.

Therefore, the installation place of the muffler chamber 49 can be selected in a wide range such as the discharge member 5, the base plate 4 of the fixed scroll 2, or a place spreading over both.

Figure 3:
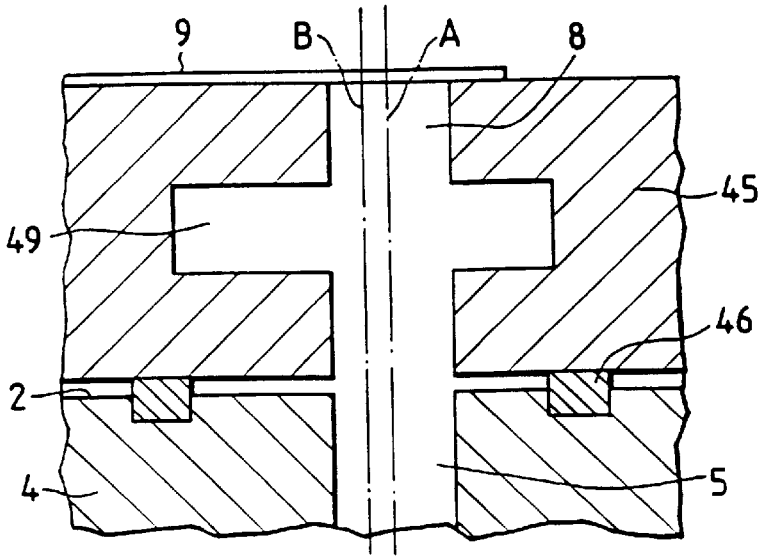
FIG. 3 is an enlarged longitudinal sectional view of the first embodiment of the invention.

In FIG. 3, the muffler chamber 49 is installed in the discharge member 45; it can be installed in the base plate 4 of the fixed scroll 2 or a place spreading over the discharge member 45 and the base plate 4.

In FIG. 2, the muffler chamber 49 is installed in the discharge member 45 and moreover between the discharge member 45 and the base plate 4 of the fixed scroll 2, so that it can be easily machined.

Figure 4:
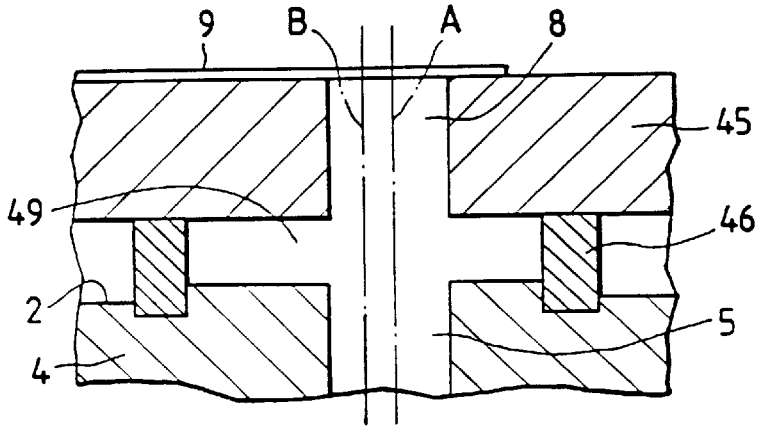
FIG. 4 is an enlarged longitudinal sectional view of the first embodiment of the invention.

When the muffler chamber 49 is installed between the discharge member 45 and the base plate 4 of the fixed scroll 2, it can be installed on the base plate 4 side of the fixed scroll 2 as in FIG. 2, and further the seal member 46 may be enlarged to form the muffler chamber 49 between the discharge member 45 and the base plate 4 of the fixed scroll 2, as shown in FIG. 4.

Further, more than one muffler chamber 49 may be provided in the refrigerant flow passage.

As described above, the installation places, the size, and the number of muffler chambers can be selected in response to the form of the scroll compressor to which the muffler chamber is applied, the noise magnitude, and noise allowance.

Figure 5:
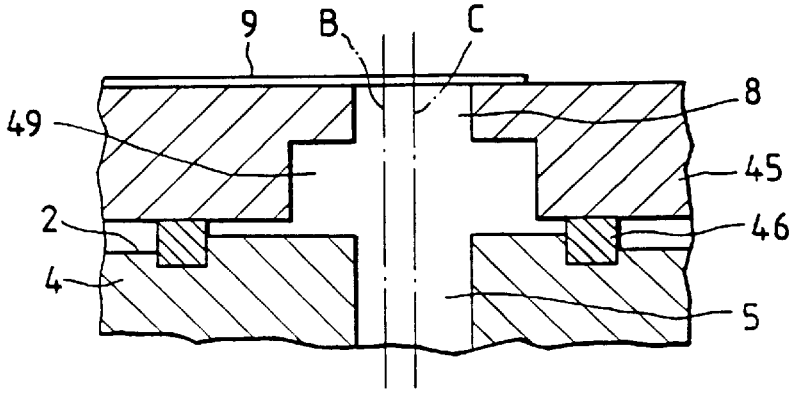
FIG. 5 is a view equivalent to FIG. 2, showing a second embodiment of the invention.

Second embodiment:

FIG. 5 is a view equivalent to FIG. 2, showing a second embodiment of the invention. Parts not shown in FIG. 5 are the same as those of the scroll compressor in FIGS. 1 and 2. Parts identical with or similar to those previously described with reference to FIGS. 1 and 2 are denoted by the same reference numerals in FIG. 5. Numeral 49 is a muffler chamber disposed in a discharge member 45 and formed concentrically with a discharge port 5 of a fixed scroll 2.

In FIG. 5, center line B is the center line of a sealed vessel 1 and center line C is the center line of the discharge port 5 of the fixed scroll 2 and the muffler chamber 49.

In the second embodiment in FIG. 5, like the first embodiment in FIGS. 1 and 2, the muffler chamber 49 is disposed in the discharge member 45, placed facing a base plate 4 of the fixed scroll 2, and communicated with a discharge port 8. Therefore, it is obvious that the second embodiment in FIG. 5 also produces similar effects to those of the first embodiment in FIGS. 1, 2, 3 and 4 although detailed description is omitted.

Since the muffler chamber 49 is formed almost concentrically with the discharge port 5 of the fixed scroll 2, a pressure ripple of a high-pressure refrigerant gas in the muffler chamber 49 spreads uniformly in the radial direction of the sealed vessel 1. Thus, a pressure loss caused by eddy occurrence of refrigerant gas, etc., in the muffler chamber 49 decreases, whereby performance of the scroll compressor can be improved.

Figure 6:
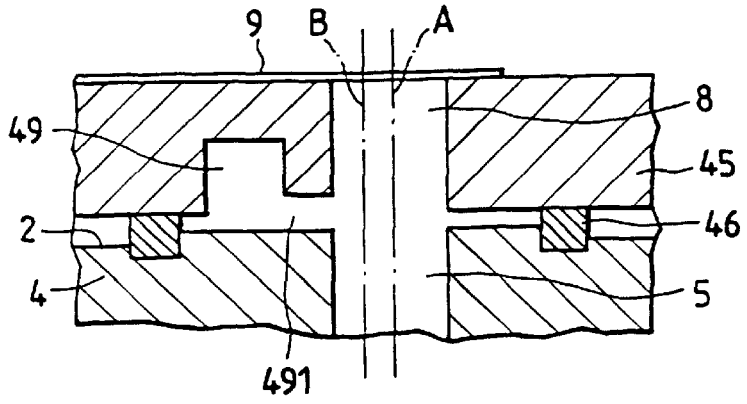
FIG. 6 is a view equivalent to FIG. 2, showing a third embodiment of the invention.
Figure 7:
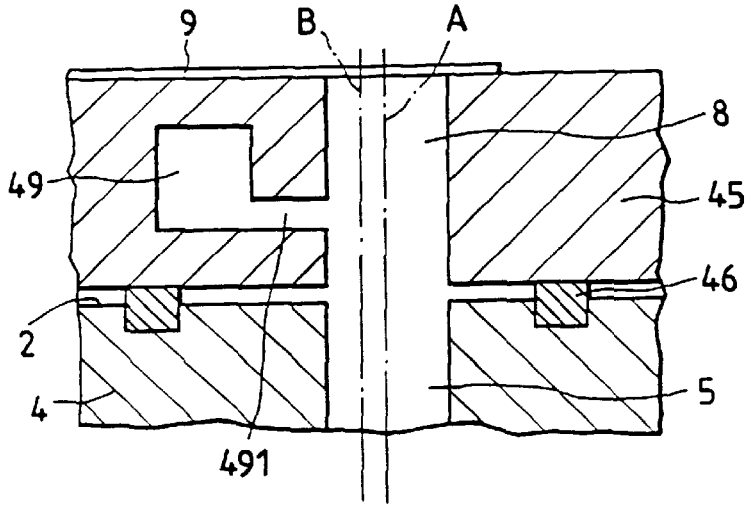
FIG. 7 is an enlarged longitudinal sectional view of the third embodiment of the invention.
Figure 8:
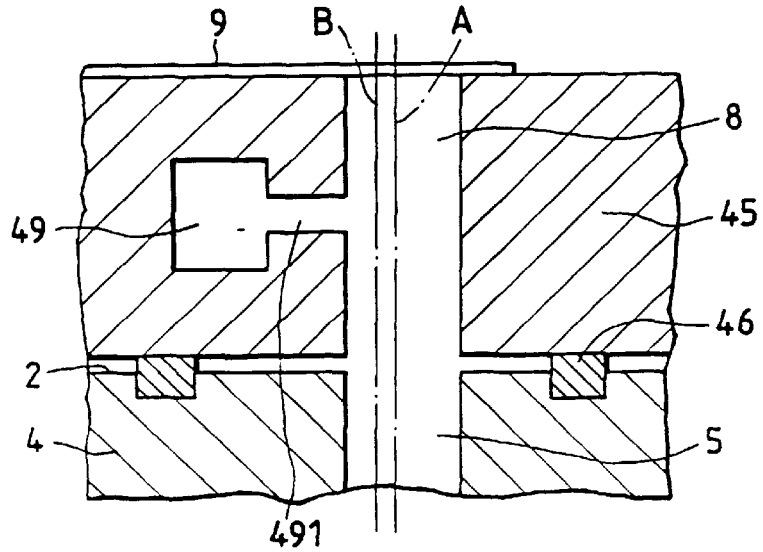
FIG. 8 is an enlarged longitudinal sectional view of the third embodiment of the invention.
Figure 9:
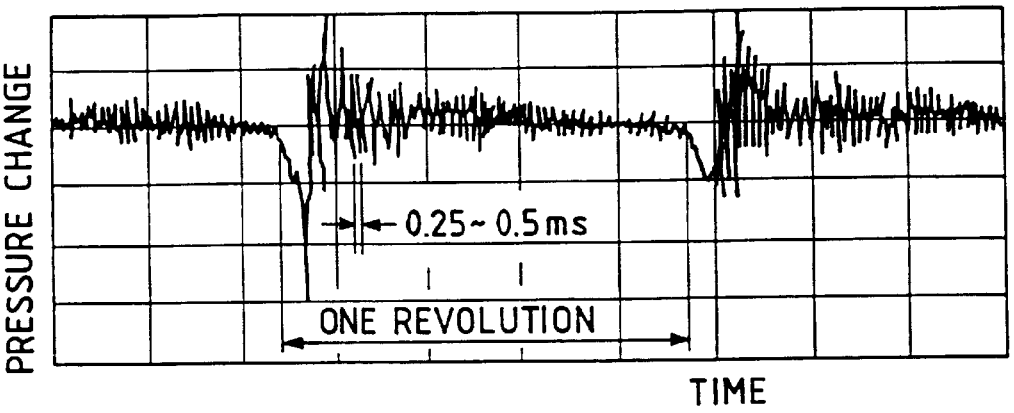
FIG. 9 PRIOR ART
FIG. 9 is a waveform chart explaining a pressure change in a discharge port in a conventional scroll compressor for explaining a pressure change in a discharge port in FIG. 6.
Figure 10:
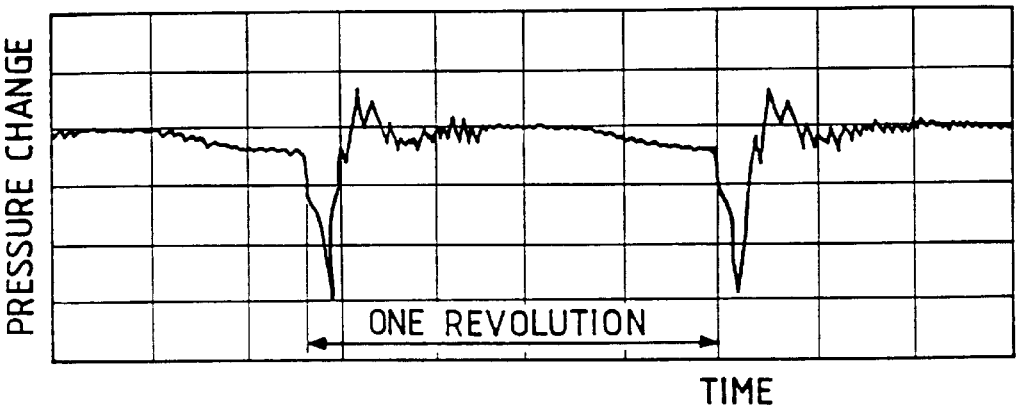
FIG. 10 is a waveform chart showing a pressure change in a discharge port in FIG. 6.

Third embodiment:

FIGS. 6 to 10 show a third embodiment of the invention. Each of FIGS. 6, 7 and 8 is a view equivalent to FIG. 2. FIG. 9 is a waveform chart showing a pressure change in the conventional scroll compressor for explaining a pressure change in a discharge port. FIG. 10 is a waveform chart showing a pressure change in a discharge port in FIGS. 6, 7 and 8. Parts not shown in FIGS. 6–10 are the same as those of the scroll compressor in FIGS. 1, 2 and 3. Parts identical with or similar to those previously described with reference to FIGS. 1 and 2 are denoted by the same reference numerals in FIGS. 6–10. Numeral 49 is a resonance-type muffler chamber in the form of a hollow space or hollow part, which is disposed in a discharge member 45, and is communicated with a refrigerant gas flow passage by a pressure guide path 491. The frequency component of the pressure ripple, attenuated within the discharge port 5, is determined by the volume of the muffler chamber 49, the sectional area and length of the pressure guide path 491, and the sectional area of the discharge port 5.

In FIGS. 6, 7 and 8, center line A is the center line of a discharge port 5 of the fixed scroll 2 and center line B is the center line of a sealed vessel 1.

In the third embodiment in FIGS. 6, 7 and 8, like the first embodiment in FIGS. 1, 2 and 3, the muffler chamber 49 is disposed in the discharge member 45, placed facing a base plate 4 of the fixed scroll 2, and communicated with a discharge port 8. Therefore, it is obvious that the third embodiment in FIGS. 6–10 also produces similar effects to those of the first embodiment in FIGS. 1, 2 and 3 although detailed description is omitted.

In the conventional scroll compressor, noise around 2 kHz is at stake. It is found as a source of the noise that the pressure ripple in the discharge port 8 has a feature that components of 2–4 kHz (components of period 0.25–0.5 ms) increase as shown in FIG. 9 and that vibration with the pressure ripple as a vibration source resonates in the sealed vessel 1, increasing noise around 2 kHz. Therefore, the volume of the muffler chamber 49, the cross-sectional area and length of the pressure guide path 491, and the cross-sectional area of the discharge port 8 are set so that the pressure ripple around 2 kHz decreases, whereby the amplitude of the pressure ripple of 2–4 kHz damps and the noise around 2 kHz at stake lessens, as shown in FIG. 10.

To use the resonance-type muffler chamber, as in the first embodiment, the high pressure space 27 may also be partitioned by the fixed scroll 2 in the sealed vessel 1 for installing the discharge valve 9 on the high pressure space 27 side of the base plate 4 of the fixed scroll 2 without providing the discharge member 45, as shown in FIG. 13 below.

The muffler chamber 49 can be provided by forming a hollow part communicating through the pressure guide path 491 with the refrigerant flow passage from the discharge port 5 of the fixed scroll 2 via the discharge valve 9 to the high pressure space 27.

Therefore, the installation place of the muffler chamber 49 can be selected in a wide range such as the discharge member 5, the base plate 4 of the fixed scroll 2, or a place spreading over both.

In FIGS. 7 and 8, the muffler chamber 49 is installed in the discharge member 45; it can be installed in the base plate 4 of the fixed scroll 2 or a place spreading over the discharge member 45 and the base plate 4.

In FIG. 6, the muffler chamber 49 is installed in the discharge member 45 and moreover between the discharge member 45 and the base plate 4 of the fixed scroll 2, so that it can be easily machined.

Further, more than one muffler chamber 49 may be provided so as to communicate with the refrigerant flow passage.

As described above, the installation places, the size, and the number of muffler chambers can be selected in response to the form of the scroll compressor to which the muffler chamber is applied, the noise magnitude, and noise allowance. Particularly in the resonance-type muffler chamber, if a specific frequency source of noise is large, noise of the specific frequency can be damped selectively.

Figure 11:
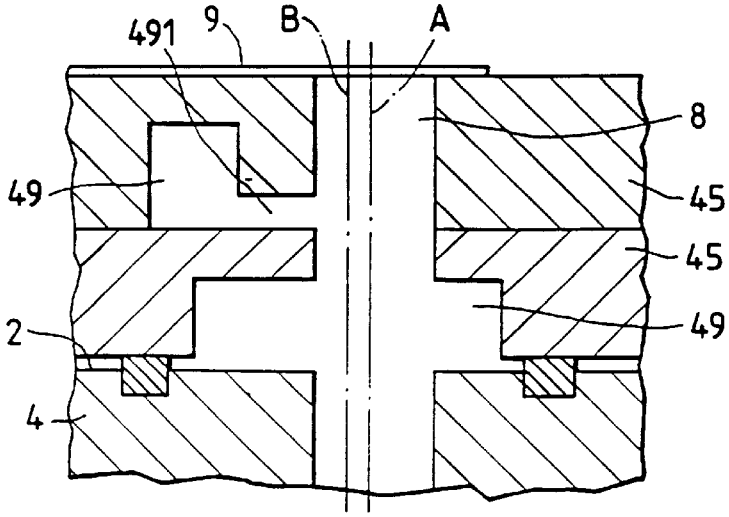
FIG. 11 is an enlarged longitudinal sectional view of a fourth embodiment of the invention.

Fourth embodiment:

FIG. 11 is also a view equivalent to FIG. 2, showing a fourth embodiment of the invention. Parts not shown in FIG. 11 are the same as those of the scroll compressor in FIGS. 1 and 2. Parts identical with or similar to those previously described with reference to FIGS. 1, 2, and 6 are denoted by the same reference numerals in FIG. 11. Both the muffler chamber having a diameter larger than that of the discharge port 5 of the fixed scroll 5 described in the first embodiment and the resonance-type muffler chamber communicating through the pressure guide path 491 with the refrigerant gas flow passage described in the third embodiment are provided as muffler chambers 49. Therefore, they will not be again discussed in detail; it is obvious that the fourth embodiment in FIG. 11 can also produce similar effects to those of the embodiment in FIGS. 1 and 2.

Since both the muffler chamber having a diameter larger than that of the discharge port 5 of the fixed scroll 5 described in the first embodiment and the resonance-type muffler chamber communicating through the pressure guide path 491 with the refrigerant gas flow passage described in the third embodiment are provided, the effects described in both the first and third embodiments are produced. Thus, noise of the scroll compressor with pressure ripple in the discharge port 8 as a vibration source can be suppressed, quieting the operation of the scroll compressor. Particularly, large noise of a specific frequency is selectively damped in the resonance-type muffler chamber and therefore more sufficient noise suppression is enabled together with the function of the other muffler chamber.

Figure 12:
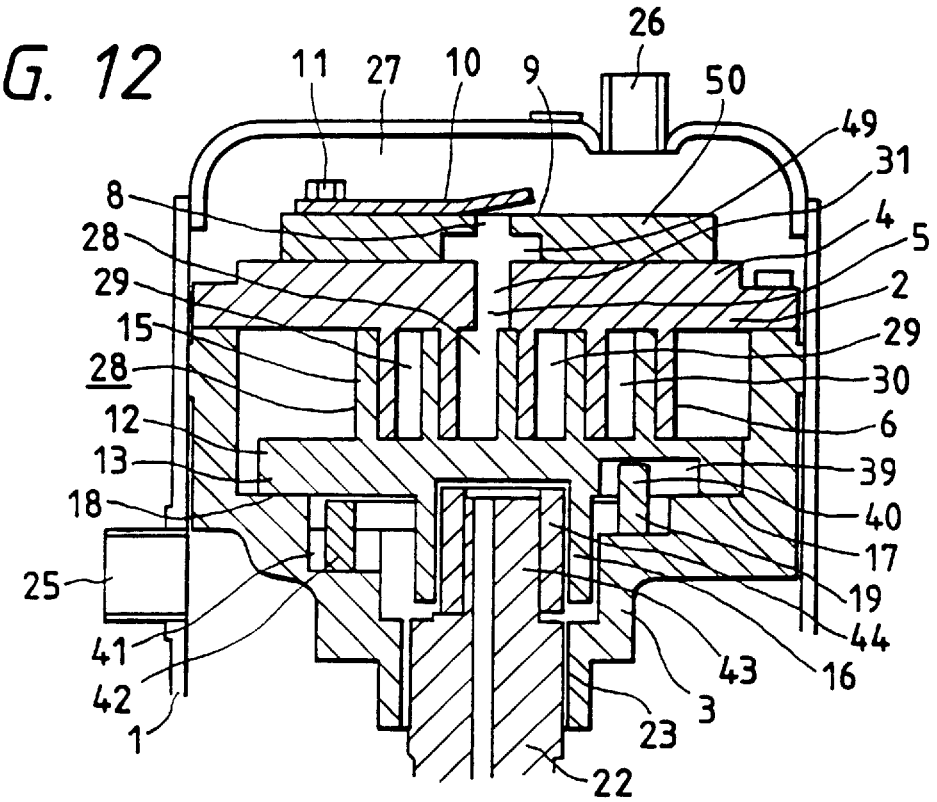
FIG. 12 is a view equivalent to FIG. 1, showing a fifth embodiment of the invention.

Fifth embodiment:

FIG. 12 is a view equivalent to FIG. 1, showing a fifth embodiment of the invention. Parts not shown in FIG. 12 are the same as those of the scroll compressor in FIGS. 1 and 2. Parts identical with or similar to those previously described with reference to FIGS. 1 and 2 are denoted by the same reference numerals in FIG. 12. Numeral 50 is a discharge member which is fixed to the side of a base plate 4 of a fixed scroll 2 opposed to a plate-like spiral tooth 6 and is provided with a discharge port 8 and a muffler chamber 49 communicated with the discharge port 8 at the center. A discharge valve 9 is mounted on the side of the discharge member 50 opposed to the fixed scroll 2.

If the fixed scroll 2 is fixed to a frame 3 and the structure is not an axial compliant structure, the discharge member 50 is provided in place of a high and low pressure separator 45 in the embodiment in FIG. 12.

In the fifth embodiment in FIG. 12, like the first embodiment in FIGS. 1 and 2, the muffler chamber 49 is disposed in the discharge member 45, placed facing the base plate 4 of the fixed scroll 2, and communicated with the discharge port 8. Therefore, it is obvious that the fifth embodiment in FIG. 12 also produces similar effects to those of the first embodiment in FIGS. 1 and 2 although detailed description is omitted.

Also, it is obvious that, in case the resonance type muffler as shown in FIG. 6 is provided, similar functions and effects as those in the third embodiment can be obtained.

If the fixed scroll 2 is fixed to the frame 3 and the structure is not an axial compliant structure, the discharge member 50 is provided in place of a high and low pressure separator and is formed with the muffler chamber. Thus, the muffler chamber 49 can be provided at less costs.

Sixth embodiment:

FIGS. 13 to 15D show a fifth embodiment of the invention. FIG. 13 is a longitudinal sectional view of the main part of a scroll compressor according to the sixth embodiment. Each of FIGS. 14A and 14B is an enlarged perspective view of a respective counterboring part in FIG. 13. Each of FIG. 15A to 15D is a plan view explaining the operation of the scroll compressor in FIG. 13. Parts identical with or similar to those previously described with reference to FIGS. 1 and 2 are denoted by the same reference numerals in FIGS. 13–15D. Numeral 36 is a counterboring part disposed in a base plate 4 of a fixed scroll 2 and having a cutaway part corresponding to the center of a plate-like spiral tooth 6.

Numeral 37 is a counterboring part disposed in a base plate 13 of an orbiting scroll 12 and having a cutaway part corresponding to the center of a plate-like spiral tooth 15. Numeral 51 is a notch made at the tip center of the center of the plate-like spiral tooth 15 of the orbiting scroll 12.

Numeral 52 is a counterboring communication part communicated with the counterboring part 36 of the fixed scroll 2 and an intermediate pressure chamber 29 and numeral 53 is a counterboring communication part communicated with the counterboring part 37 of the orbiting scroll 12 and the intermediate pressure chamber 29.

Numeral 54 is an outer side face of the center of the plate-like spiral tooth 6 of the fixed scroll 2, numeral 55 is an outer side face of the center of the plate-like spiral tooth 15 of the orbiting scroll 12, numeral 56 is a side face communication part between the plate-like spiral teeth 6 and 15.

In the scroll compressor having the structure, when an electric motor is energized, the orbiting scroll 12 is driven via a main shaft 22, a slider 44 revolved by the main shaft 22, and an orbiting bearing 16. At this time, rotation of the orbiting scroll 12 with respect to a frame 3, namely, the fixed scroll 2 is restrained by an Oldham's ring 19. Thus, the orbiting scroll 12 makes the orbiting motion with respect to the fixed scroll 2.

A low-pressure refrigerant gas sucked through a suction pipe 25 is taken in a low pressure chamber 30 of a compression space 14 formed like a pair of crescents with the plate-like spiral tooth 6 of the fixed scroll 2 meshing with the plate-like spiral tooth 15 of the orbiting scroll 12.

The compression space 14 decreases in volume in order from the low pressure chamber 30 to the intermediate pressure chamber 29 to a high pressure chamber 28, whereby the refrigerant gas is compressed.

Next, the compressed high-pressure refrigerant gas passes through the notch 51 of the plate-like spiral tooth 15 of the orbiting scroll 12, the counterboring part 36 of the fixed scroll 2, the counterboring part 37 of the orbiting scroll 12, and the discharge port 5 of the fixed scroll 2, and is discharged into a high pressure space 27 and sent outside a sealed vessel 1 through a discharge pipe 26.

The plane of a pin part 43 of the main shaft 22 and the plane of the inner face of the slider 44 make linear slide motion in the eccentric direction of the orbiting scroll 12.

Thus, a predetermined force such as a centrifugal force acts on the orbiting scroll 12 in the eccentric direction, whereby the orbiting scroll 12 is pressed in the radial direction of the fixed scroll 2, thereby preventing a gap from occurring between the side face of the plate-like spiral tooth 15 of the orbiting scroll 12 and the side face of the plate-like spiral tooth 6 of the fixed scroll 2.

The forms and positions of the counterboring part 36 of the fixed scroll 2 and the counterboring part 37 of the orbiting scroll 12 are set as shown in FIG. 15A to 15D so that the counterboring part 36 of the fixed scroll 2 and the counterboring part 37 of the orbiting scroll 12 are communicated with the intermediate pressure chamber 29 at the counterboring communication parts 52 and 53 respectively at almost the same timing as the discharge port 5 of the fixed scroll 2 is communicated with the intermediate pressure chamber 29 after the high pressure chamber 28 and the intermediate pressure chamber 29 are communicated with each other at the side face communication part 56 between the plate-like spiral teeth.

Therefore, after the high pressure chamber 28 and the intermediate pressure chamber 29 are gently communicated with each other at the side face communication part 56 between the plate-like spiral teeth and the pressure difference between the high pressure chamber 28 and the intermediate pressure chamber 29 decreases, the counterboring part 36 of the fixed scroll 2 and the counterboring part 37 of the orbiting scroll 12 are communicated with the intermediate pressure chamber 29. Thus, rapid and large pressure fluctuation in the intermediate pressure chamber 29 just after the communication decreases, so that noise of the scroll compressor with the pressure fluctuation with a vibration source lessens.

Normally, the pressure fluctuation of the intermediate chamber 29 is twice per one revolution since the discharge port 29 of the fixed scroll 2 and the intermediate pressure chamber 29 are communicated with each other after the intermediate chamber 29 is communicated with the counterboring communication parts 52 and 53 of the base plate 4 and 13 of the fixed scroll 2 and the orbiting scroll 12. However, the forms and positions of the counterboring parts 36 and 37 are set so that the counterboring communication parts 52 and 53 of the base plates 4 and 13 of the fixed scroll 2 and the orbiting scroll 12 are communicated with the intermediate pressure chamber 29 at almost the same timing as the discharge port 5 of the fixed scroll 2 is communicated with the intermediate pressure chamber 29. Thus, when the discharge port 5 of the fixed scroll 2, the counterboring part 36 of the fixed scroll 2, and the counterboring part 37 of the orbiting scroll 12 are communicated with the intermediate pressure chamber 29, pressure fluctuation in the intermediate pressure chamber 29 occurs once per revolution, so that noise of the scroll compressor caused by the pressure fluctuation decreases.

The form of the counterboring part 36 of the fixed scroll 2 is almost the same as an involute curve of the outer side face 55 of the plate-like spiral tooth 15 of the orbiting scroll 12 when it is communicated with the intermediate pressure chamber 29. Thus, just after the communication, the counterboring communication part 52 of the fixed scroll 2 is formed in a wide range along the outer side face 55 of the plate-like spiral tooth 15 of the orbiting scroll 12.

The form of the counterboring part 37 of the orbiting scroll 12 is almost the same as an involute curve of the outer side face 54 of the plate-like spiral tooth 6 of the fixed scroll 2 when it is communicated with the intermediate pressure chamber 29. Thus, just after the communication, the counterboring communication part 53 of the orbiting scroll 12 is formed in a wide range along the outer side face 54 of the plate-like spiral tooth 6 of the fixed scroll 2.

Thus, the counterboring part 36 of the fixed scroll 2 and the counterboring part 37 of the orbiting scroll 12 are communicated with the intermediate pressure chamber 29 in a sufficient communication area to such a degree that a refrigerant gas pressure loss does not occur. Therefore, a sufficient flow passage area of high-pressure refrigerant gas can be provided, decreasing the pressure loss, thereby improving performance of the compression scroll.

The notch 51 made at the tip center of the center of the plate-like spiral tooth 6, 15 of at least either of the fixed scroll 2 and the orbiting scroll 12 provides a larger flow passage area of high-pressure refrigerant gas than the case where only the counterboring parts 36 and 37 are provided. Therefore, the pressure loss of the high-pressure refrigerant gas can be furthermore decreased, improving performance of the scroll compressor all the more.

As described above, the scroll compressor of the invention comprises a fixed scroll disposed in a sealed vessel and provided with a plate-like spiral tooth on a base plate having a discharge port for a high-pressure refrigerant gas at the center, an orbiting scroll disposed in the sealed vessel and having a base plate provided with a plate-like spiral tooth engaging the plate-like spiral tooth of the fixed scroll for forming a compression space, a discharge valve disposed at a high pressure space entrance of a refrigerant gas flow passage from the discharge port of the fixed scroll to high pressure space of the sealed vessel and opened/closed depending on a difference between pressure in a flow passage of the refrigerant gas and pressure in the high pressure space for allowing the refrigerant gas flow passage and the high pressure space to communicate with each other and shutting off them, and a muffler chamber communicating with the refrigerant gas flow passage from the discharge port of the fixed scroll to the discharge valve for absorbing pressure ripple when the discharge valve is closed.

The muffler chamber suppresses occurrence of an impulse wave caused by pressure ripple in the discharge port of the fixed scroll caused by water hammering just after the discharge valve is closed. Therefore, noise with pressure ripple in the discharge port as a vibration source can be lessened for quieting the operation of the scroll compressor.

Since the muffler chamber is an enlarged part of a flow passage cross section formed in the refrigerant gas flow passage from the discharge port of the fixed scroll to the discharge valve, the enlarged part of the flow passage cross section suppresses occurrence of an impulse wave caused by pressure ripple in the discharge port. Therefore, noise of the scroll compressor is lessened, quieting the operation thereof. Moreover, the muffler chamber is formed as the enlarged part of the flow passage cross section in the gas flow passage, so that it is easily formed.

The scroll compressor comprises a discharge member disposed in the sealed vessel and placed facing the base plate of the fixed scroll and having a discharge port opposed to the discharge port of the fixed scroll, a discharge valve opposed to the discharge port of the discharge member and opened/closed depending on a difference between pressure in refrigerant gas flow passage and pressure in high pressure space, and a muffler chamber formed in at least either of the base plate of the fixed scroll and the discharge member and having a diameter larger than that of the discharge port of the fixed scroll. Thus, in addition to the above-mentioned effects, the discharge member is provided, thereby making muffler chamber installation more flexible.

The scroll compressor comprises a muffler chamber having a height dimension along a longitudinal axis line of the sealed vessel smaller than the diameter dimension of the discharge port of the fixed scroll.

Since the muffler chamber of the invention has the height dimension along the longitudinal axis line of the sealed vessel smaller than the diameter dimension of the discharge port of the fixed scroll, a pressure loss caused by refrigerant gas eddy occurrence, etc., in the muffler chamber decreases. Thus, the effect of suppressing performance degradation of the scroll compressor caused by muffler chamber installation is produced.

The scroll compressor of the invention comprises a muffler chamber having the center placed concentrically with the discharge port of the fixed scroll.

Since the muffler chamber has the center placed concentrically with the discharge port of the fixed scroll, pressure ripple of high-pressure refrigerant gas in the muffler chamber spreads uniformly in the axial direction of the sealed vessel. Thus, a pressure loss caused by high-pressure refrigerant gas eddy occurrence, etc., decreases, and the effect of suppressing performance degradation of the scroll compressor caused by muffler chamber installation is produced.

The scroll compressor of the invention comprises a muffler chamber having the center placed concentrically with a longitudinal axis line of the sealed vessel.

Since the muffler chamber has the center placed concentrically with the longitudinal axis line of the sealed vessel, it becomes concentric with related members such as the high and low pressure separator having the muffler chamber and is easily machined, and the machining costs can be reduced.

The muffler chamber is a hollow part communicating through a pressure guide path with the refrigerant gas flow passage from the discharge port of the fixed scroll to the discharge valve.

Thus, the muffler chamber becomes of resonance type and pressure ripple of high-pressure refrigerant gas caused by specific frequencies can be damped. Therefore, if a specific frequency source of noise is large, noise of the specific frequency can be damped efficiently.

The scroll compressor having the hollow part comprises a discharge member disposed in the sealed vessel and placed facing the base plate of the fixed scroll and having a discharge port opposed to the discharge port of the fixed scroll, a discharge valve opposed to the discharge port of the discharge member and opened/closed depending on a difference between pressure in refrigerant gas flow passage and pressure in high pressure space, and a muffler chamber formed in at least either of the base plate of the fixed scroll and the discharge member.

Thus, in addition to the above-mentioned effect of the resonance-type muffler chamber, the discharge member is provided, thereby making resonance-type muffler chamber installation more flexible.

The scroll compressor of the invention comprises a muffler chamber having a volume to a degree of preventing the orbiting scroll from making the orbiting motion in a reverse direction to normal motion time when a reverse flow of refrigerant gas occurs just after the scroll compressor stops.

Thus, the muffler chamber can produce the effect of quieting the operation of the scroll compressor and moreover the effect of preventing production of reverse rotation sound just after the scroll compressor stops.

The scroll compressor of the invention comprises a discharge member disposed on the sealed vessel discharge pipe side of the fixed scroll base plate and a muffler chamber formed between the discharge member and the fixed scroll base plate in the refrigerant gas flow passage.

Thus, the muffler chamber can be easily formed and produce the effect of quieting the operation of the scroll compressor; it can be equipped at low costs, reducing the manufacturing costs.

The scroll compressor of the invention comprises a fixed scroll disposed axially movably on an axis line of the sealed vessel and mounted by an axial compliant structure, a high and low pressure separator disposed in the sealed vessel and placed facing the base plate of the fixed scroll and having a discharge port opposed to the discharge port of the fixed scroll, and a muffler chamber formed between the fixed scroll base plate and the high and low pressure separator in the refrigerant gas flow passage.

Thus, the muffler chamber can be easily mounted without losing the axial compliant function, and produce the effect of quieting the operation of the scroll compressor, providing the scroll compressor having the axial compliant function.

According to the invention, there is provided a scroll compressor comprising a fixed scroll disposed in a sealed vessel and provided with a plate-like spiral tooth on a base plate having a discharge port for a high-pressure refrigerant gas at the center, an orbiting scroll disposed in the sealed vessel and having a base plate provided with a plate-like spiral tooth engaging the plate-like spiral tooth of the fixed scroll for forming a compression space consisting of a high pressure chamber, an intermediate pressure chamber, and a low pressure chamber, and a counterboring part made in at least either of the base plates of the fixed and orbiting scrolls, having a cutaway part corresponding to the center of the plate-like spiral tooth of the base plate, and set to a form and position such that when the fixed and orbiting scrolls operate, the counterboring part communicates with the intermediate pressure chamber at a later timing than the high pressure chamber and the intermediate pressure chamber communicate with each other on side faces of the plate-like spiral teeth of the fixed and orbiting scrolls.

Thus, the counterboring part made in at least either of the base plates of the fixed and orbiting scrolls and having a cutaway part corresponding to the center of the plate-like spiral tooth of the base plate communicates with the intermediate pressure chamber at a later timing than the high pressure chamber and the intermediate pressure chamber communicate with each other on side faces of the plate-like spiral teeth of the fixed and orbiting scrolls. Thus, the scroll compressor has the structure wherein the counterboring part is made in at least either of the base plates of the fixed and orbiting scrolls, decreasing rapid and large pressure change in the compression space when the counterboring part communicates with the intermediate pressure chamber. Therefore, noise with the pressure ripple as a vibration source can be lessened for quieting the operation of the scroll compressor.

The scroll compressor of the invention comprises a counterboring part made in at least either of the base plates of the fixed and orbiting scrolls, having a cutaway part corresponding to the center of the plate-like spiral tooth of the base plate, and set to a form and position such that when the fixed and orbiting scrolls operate, the counterboring part communicates with the intermediate pressure chamber at the same timing as the discharge port of the fixed scroll communicates with the intermediate pressure chamber.

Thus, the counterboring part made in at least either of the base plates of the fixed and orbiting scrolls and having a cutaway part corresponding to the center of the plate-like spiral tooth of the base plate communicates with the intermediate pressure chamber at the same timing as the discharge port of the fixed scroll communicates with the intermediate pressure chamber. Thus, pressure change in the intermediate pressure chamber when the counterboring part communicates with the intermediate pressure chamber occurs once per revolution. Therefore, noise with the pressure ripple as a vibration source can be lessened for quieting the operation of the scroll compressor.

According to the invention, there is provided a scroll compressor comprising a fixed scroll disposed in a sealed vessel and provided with a plate-like spiral tooth on a base plate having a discharge port for a high-pressure refrigerant gas at the center, an orbiting scroll disposed in the sealed vessel and having a base plate provided with a plate-like spiral tooth engaging the plate-like spiral tooth of the fixed scroll for forming a compression space consisting of a high pressure chamber, an intermediate pressure chamber, and a low pressure chamber, and a counterboring part made in at least either of the base plates of the fixed and orbiting scrolls and having a cutaway part corresponding to the center of the plate-like spiral tooth of the base plate and a part formed along an involute curve.

Thus, the counterboring part is made in at least either of the base plates of the fixed and orbiting scrolls and has a cutaway part corresponding to the center of the plate-like spiral tooth of the base plate and a part formed along an involute curve, whereby just after either of the counterboring parts of the fixed and orbiting scrolls communicates with the intermediate pressure chamber, a communication area is formed in a wide range along the outer side faces of the opposed plate-like spiral teeth. Thus, a sufficient flow passage area of a high-pressure refrigerant gas is provided, decreasing a pressure loss of the high-pressure refrigerant gas, improving performance of the scroll compressor.

At least either of the fixed and orbiting scrolls formed with the counterboring part is provided with a plate-like spiral tooth having a notch at the tip center of the center.

Thus, the high-pressure refrigerant gas flow passage is enlarged to the area resulting from adding the notch made at the tip center of the center of the plate-like spiral tooth to the counterboring part of at least either of the fixed and orbiting scrolls. Thus, furthermore the pressure loss of the high-pressure refrigerant gas is decreased, improving performance of the scroll compressor.

What is claimed is:

1. A scroll compressor comprising:

a fixed scroll disposed in a sealed vessel and provided with a plate-like spiral tooth on a base plate having a discharge port for a high-pressure refrigerant gas at a center;

an orbiting scroll disposed in said sealed vessel and having a base plate provided with a plate-like spiral tooth engaging said plate-like spiral tooth of said fixed scroll for forming a compression space;

a discharge member positioned between said fixed scroll and a high pressure space of said sealed vessel;

a discharge valve disposed at an end of a refrigerant gas flow passage from said discharge port of said fixed scroll, passing through said discharge member to said high pressure space of said sealed vessel and opened/closed depending on a difference between pressure in the flow passage of the refrigerant gas and pressure in the high pressure space for allowing said refrigerant gas flow passage and the high pressure space to communicate with each other and for shutting off said communication;

means defining a muffler chamber in said discharge member and communicating with the refrigerant gas flow passage for absorbing pressure ripple when said discharge valve is closed, wherein said muffler chamber never communicates with said high pressure space independent of said communication with said gas flow passage; and a pressure guide passage communicating the refrigerant gas flow passage with said muffler chamber, wherein at least a portion of said discharge member is interposed, in a radial direction, between said muffler chamber and said refrigerant gas flow passage.

2. The scroll compressor of claim 1 wherein said refrigerant gas flow passage includes said discharge port of said fixed scroll and a discharge port of said discharge member, wherein said discharge valve is disposed at said discharge port of said discharge member and said at least a portion of said discharge member is radially interposed between said muffler chamber and said discharge port of said discharge member.

3. The scroll compressor of claim 2 wherein said pressure guide path is formed in said discharge member.

* * * * *